US005462272A

United States Patent [19]

Staten

[11] Patent Number: 5,462,272

[45] Date of Patent: Oct. 31, 1995

[54] FOOTBALL TRAINING SLED

[75] Inventor: Kenneth E. Staten, Clare, Mich.

[73] Assignee: Rogers Athletic Company, Clare, Mich.

[21] Appl. No.: 322,093

[22] Filed: Oct. 12, 1994

[51] Int. Cl.[6] ..... A63B 67/00

[52] U.S. Cl. ..... 273/55 R

[58] Field of Search ..... 273/55 A, 55 B

[56] References Cited

U.S. PATENT DOCUMENTS

| | | | |
|---|---|---|---|
| 3,237,944 | 3/1966 | Kopp . | |
| 3,329,428 | 7/1967 | Moran | 273/55 R |
| 3,416,795 | 12/1968 | Lewis et al. . | |
| 3,458,192 | 7/1969 | Trice, Jr. | 273/55 R |
| 3,556,523 | 3/1969 | Hooker . | |
| 3,674,265 | 7/1972 | Sheets | 273/55 R |
| 3,827,690 | 8/1974 | Rogers . | |
| 3,889,948 | 6/1975 | Visco . | |
| 3,889,949 | 6/1975 | Gardner | 273/55 R |
| 3,998,456 | 12/1976 | Sherman . | |
| 4,087,089 | 5/1978 | Forrest | 273/55 R |
| 4,573,680 | 3/1986 | McNally . | |
| 4,688,795 | 8/1987 | Callaway | 273/55 R |
| 4,720,103 | 1/1988 | Palladino | 273/55 R |
| 4,943,057 | 7/1990 | Felder . | |
| 5,143,372 | 9/1992 | Wilson | 273/55 R |

*Primary Examiner*—Theatrice Brown
*Attorney, Agent, or Firm*—Learman & McCulloch

[57] ABSTRACT

A practice sled for use in training football players to perfect their blocking and block evading techniques has a frame with a forwardly extending, blocking pad carrying arm mounted for vertical travel. The blocking pad has a rearwardly extending component telescopically received by the arm for rearward movement under the impetus of a trainee forcing the blocking pad rearwardly and a yieldable force resisting device is connected to resist rearward movement of the blocking pad. A restraining mechanism is operable when the blocking pad is in forward position to prevent the trainee from raising the arm until the blocking pad has moved a predetermined distance rearwardly on the arm.

11 Claims, 2 Drawing Sheets

10
F
P
15
B
15a
12
18
11
19
17
13
22
14
23

15
P
F
16
15a
12
16
17
13
14
23
22

FOOTBALL TRAINING SLED

BACKGROUND OF THE INVENTION

The present invention is concerned with equipment for training football players, particularly in the art of blocking or evading blocks. Proper technique requires the player to, first of all, engage the opposing player and reverse his momentum prior to rolling his hips forwardly to initiate the lifting action required to control the opposing player. This pivoting of the body from the hips, converts the horizontal movement generated forwardly into a force with a vertical component which tends to lift the opposing player so as to render the opposing player momentarily unable to assist his team mates or make a play.

A mistake commonly made, when the player rolls his hips forwardly and lifts, is that he does this prior to reversing the momentum of the opposing player, which reduces the power and effectiveness of a block, for example. When training with the device of the present invention, the player is forced to move in a forward direction a predetermined distance before he can successfully roll his hips and lift, and the training sled of the present invention thus aids a player to develop the most powerful and effective blocking and tackling techniques.

While other blocking sleds have utilized blocking pads or dummies which are rearwardly resiliently yieldable under forceful blocking pressure, none have, to my knowledge, sought to improve such devices in the manner which will be disclosed.

BRIEF SUMMARY OF THE INVENTION

The present invention improves athletic training sleds in which the blocking pads are moved rearwardly by the player against a force-resisting mechanism which is incorporated in the training device. The training device does not rely upon fixed tracks along which the blocking dummy must run, and which do not accommodate to players of differing height and physique. It includes a front to rear extending frame, including a lower section or base which may be detachably anchored to the ground or to a wall, or which may utilize the weight of the equipment itself to provide resistance to movement of the equipment along the ground upon the onslaught of the trainee.

A blocking pad having a rearwardly extending component is telescopically mounted by an ultimately raisable upper arm structure having a yieldable force resisting device connected to resist rearward or inward movement of the blocking pad. A restraining mechanism is operable when the blocking pad is in forward position to prevent the trainee from raising the arm structure until the blocking pad has moved a predetermined distance rearwardly.

One of the prime objects of the present invention is to design a training aid which requires a player to simulate reversing the momentum of the opposing player, prior to initiating a lifting action which the player is free to execute without impedance.

A further object of the invention is to provide a training sled which facilitates hip rolling and full arm extension.

Another object of the invention is to provide a training device which teaches a football player to successfully reverse the momentum of the opposing player before rolling his hips to lift the opposing player and control him for the time required to eliminate him from a play.

Still another object of the invention is to provide a device which can be used singly, or in company with a plurality of such devices, and which can be economically manufactured and marketed.

Another object of the invention is to provide a training device which is of durable character and operates smoothly.

Still another object of the invention is to provide a device of modular construction which can be ganged together in, for example, two to seven man configurations via connecting tubes, or which can utilize wall mounts which might, for instance, be used in weight rooms for off-season training.

Another object of the invention is to provide a training device wherein the rearwardly telescoping blocking pad remains latched during an initial predetermined portion of its inward or rearward movement and then is automatically unlatched for free swinging vertical movement.

Another object of the invention is to provide a training sled of the character described wherein the device is automatically relatched under the influence of the forces of gravity when the blocking pad is resiliently returned to front position.

Other objects and advantages of the invention will become apparent with reference to the accompanying drawings and the accompanying descriptive matter.

DETAILED DESCRIPTION

Figure 1:
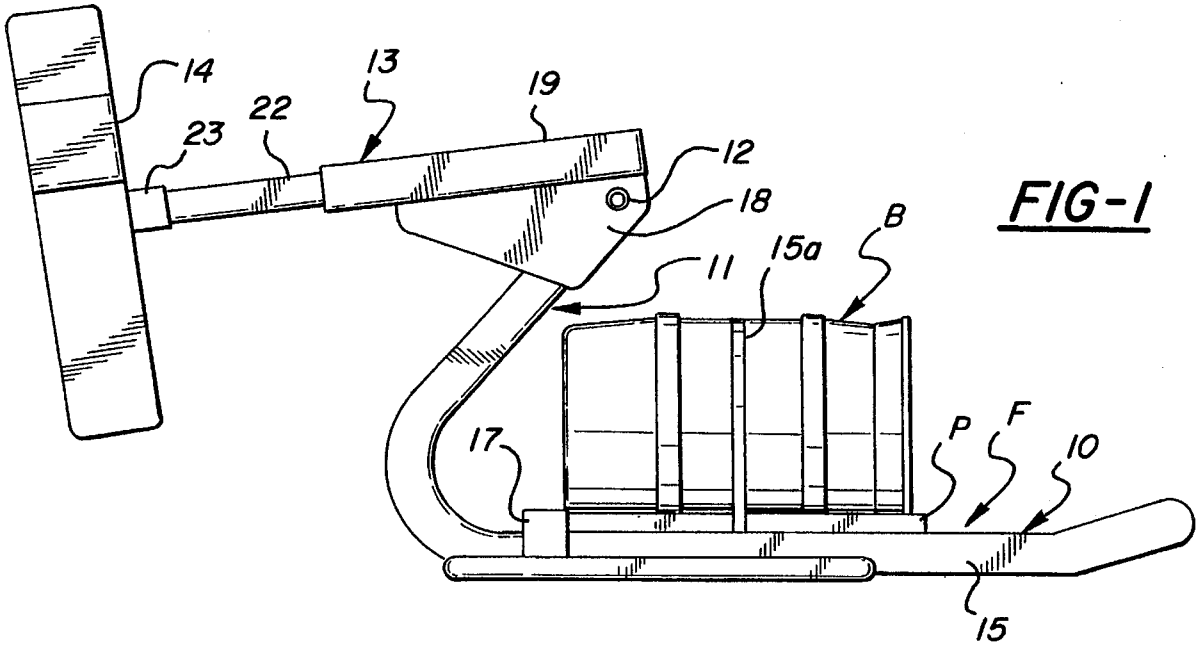
FIG. 1 is a side elevational view of the training sled.
Figure 2:
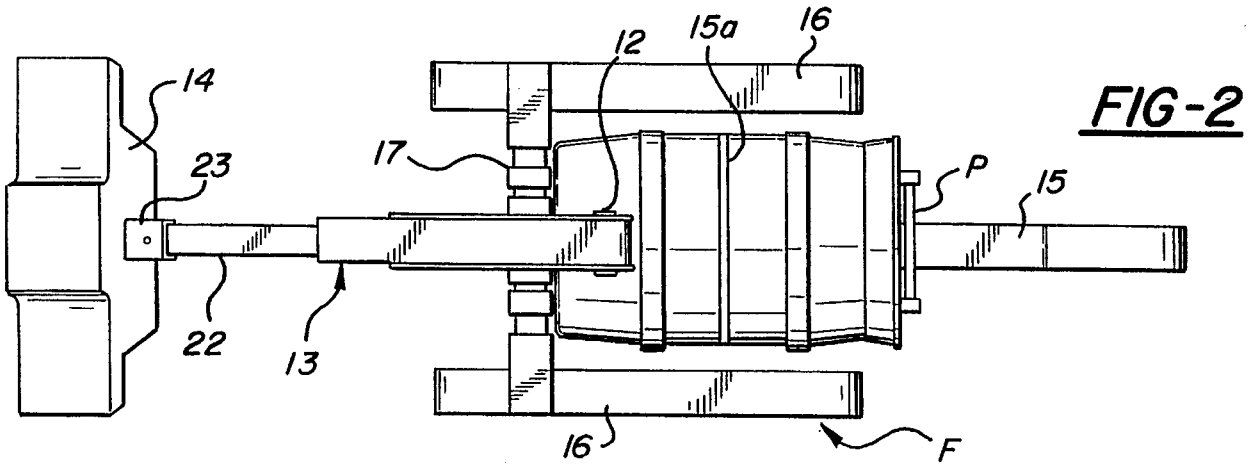
FIG. 2 is a top plan view thereof.

Referring now more particularly to the accompanying drawings, and in the first instance to FIGS. 1 and 2, the sled is shown as having a frame, generally designated F, which may include a ground engaging base or lower section, generally designated 10, and an upwardly extending, rearwardly inclined upper section, generally designated 11. Alternatively, the frame F could comprise support members which mount to a side wall and/or to flooring when the device is to be used indoors. Pivotally mounted on the section 11, as by a pin 12, is a forwardly extending arm structure, generally designated 13, which has at its front end a cushioned blocking pad or dummy 14 of conventional configuration functioning as the front end of a blocking pad assembly.

In the version illustrated in the drawings, the frame F includes a central ground engaging runner 15 connected with upper section 11, and also connected with side outrigger ground engaging supports 16 which are joined to runner 15, as by a cross arm 17. A barrel B can be strapped as at 15*a*, or otherwise secured, to a platform P fixed on runner 15 and frame F, and then filled with water to weight the frame F.

Figure 3:
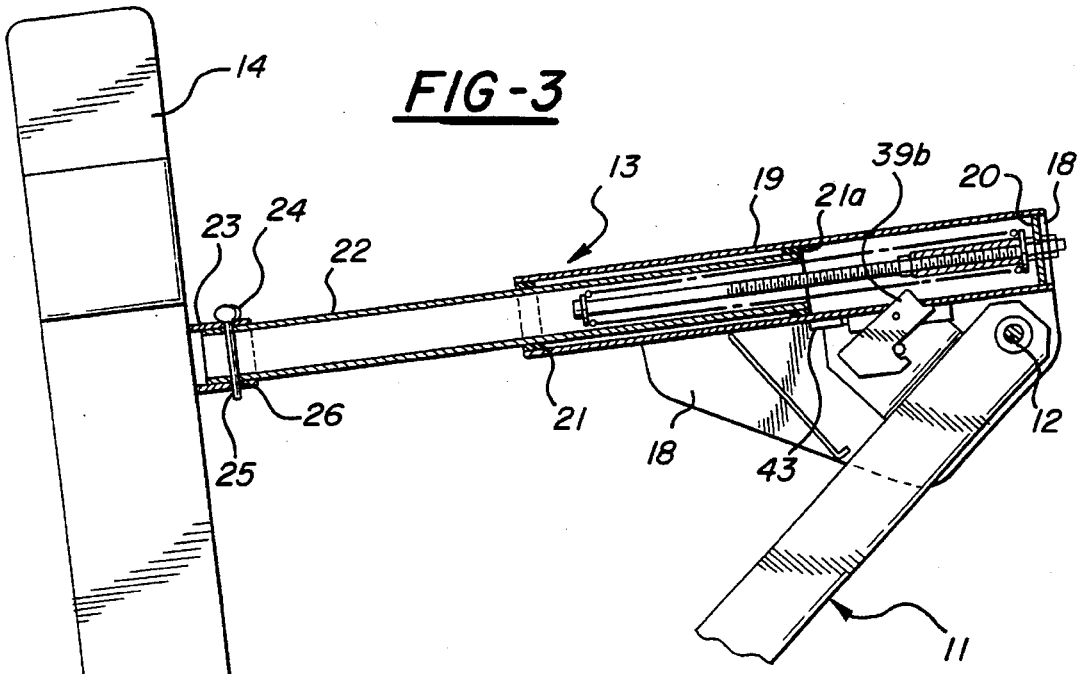
FIG. 3 is a fragmentary, enlarged, sectional, side elevational view, with the arm structure in an initial latched position which prevents upward movement of the blocking pad.
Figure 4:
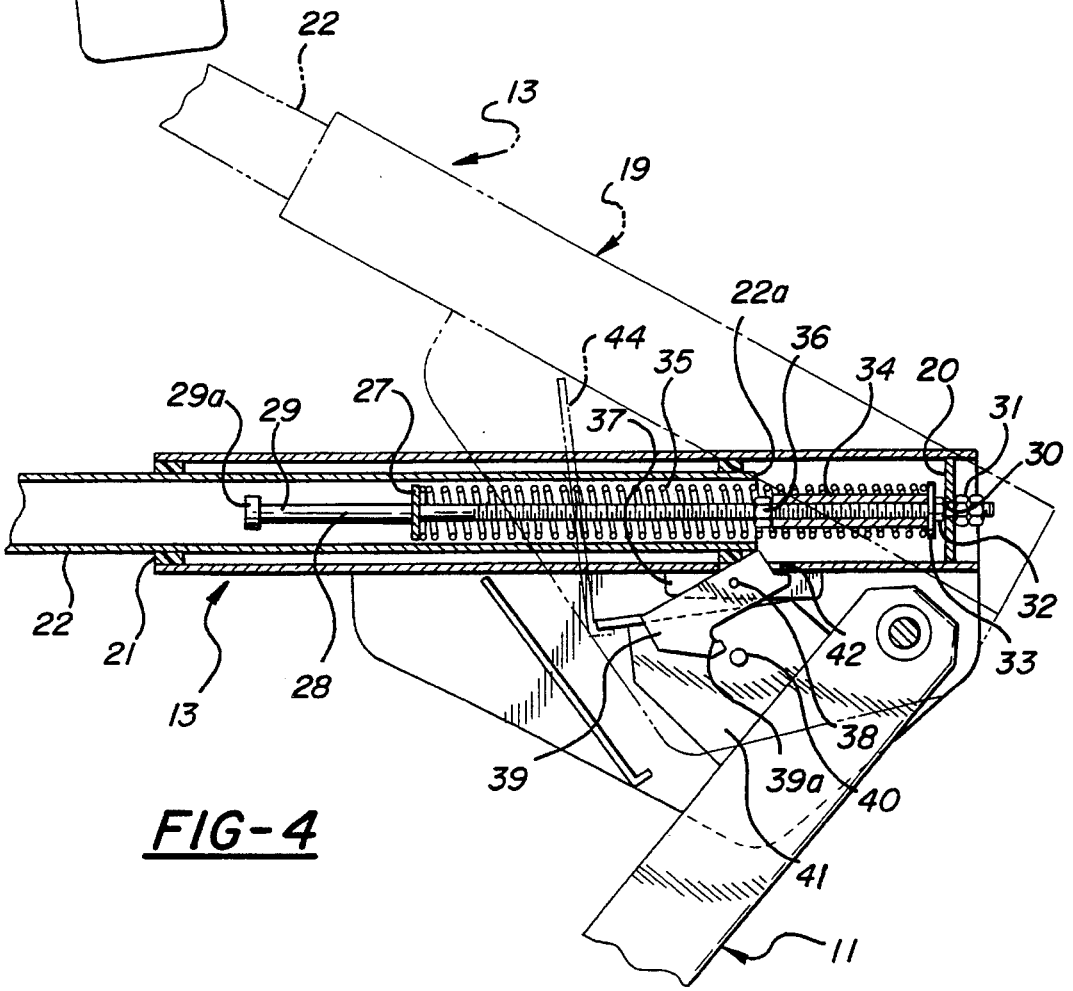
FIG. 4 is a similar, fragmentary, enlarged view thereof showing the arm structure in unlatched position, the chain lines illustrating a maximum raised position of the blocking pad arm structure.

As FIGS. 3 and 4 particularly indicate, the arm structure 13 includes downwardly extending clevis plates or brackets 18 through which pin 12 extends to pivotally mount the arm structure 13. Fixed between the depending plates 18, is a cylinder 19 which has a rear end wall 20 and a front end mounting a suitable bushing 21 of a diameter to telescopically receive a rearwardly extending operating sleeve component 22 connected to pad 14 and forming a part of the blocking pad assembly. The latter may be affixed to a hub 23 provided on pad 14 by a removable pin 24 extending through openings 25 in hubs 23, and openings 26 provided in the component 22. An intermediate bushing 21*a* is also provided in cylinder 19 to receive the sleeve component 22.

As FIG. 4 particularly indicates, the sleeve component 22 has fixed to it a transverse actuator plate or member 27 which has an opening 28 through it for receiving a cylinder-mounted, partially threaded rod 29 having a head 29*a* of larger diameter than the opening 28. At its rear end, rod 29 is secured to cylinder wall 20, the rod rear end passing through an opening 30 in the wall 20 and being secured by a lock nut assembly 31. A nut 32, provided internally of wall 20 on the threaded rod 29, positions a washer 33 which functions to retain a spring support sleeve 34 and a surrounding coil spring 35. Spring 35 is under compression in FIG. 3 and engages actuator plate 27 with a predetermined tension. Also provided on the threaded rod 29, is a nut 36 which positions the front end of spring support sleeve 34 as shown. Dependent from the cylinder 19 are bracket plates 37 for supporting a pin 38 on which a restraining mechanism comprising a hook-shaped latch 39 is rotatable. The hook recess 39*a* provided in the lower end of latch 39 is adapted to hook under a latch pin 40, fixed on a plate 41 which may be welded or otherwise secured to the upper frame portion 11. The latch 39 is shown in engaged position in FIG. 3, and in disengaged position in FIG. 4. The latch 39 is considered to be only one form of restraining mechanism for holding the arm structure in place until a predetermined inward movement has occurred. It will be observed that an upper cam corner 39*b* provided on latch 39 extends vertically through a slotted opening 42 provided in the lower end of cylinder 19 into the path of the end 22*a* of sleeve 22 which functions as a trip so that sleeve 22, when it is moved rearwardly to telescope further into cylinder or sleeve 19, engages the latch 39 to pivot the latch 39 into the position shown in FIG. 4.

Also fixed on member 41 is a stop plate 43 which is out of the path of vertical swinging movement of latch 39, and which is in register to be engaged by an L-shaped hook member 44 fixed to one of the plates 18 and located out of the path of movement of the latch 39.

THE OPERATION

In operation, the football trainee, usually from a crouched position, springs forwardly to push the blocking dummy 14 rearwardly, thus causing the plate 27 connected with pad component 22 to further compress the spring 35 and exert a reactionary force. When the inner end of sleeve component 22 strikes latch 39, the latch 39 is pivoted from the locked position shown in FIG. 3 to the unlocked position shown in FIG. 4, and the arm structure 13 is then freed to pivot upwardly about the pin 12 until member 44 engages under stop 43 and limits further travel upwardly to the chain line position indicated in FIG. 4.

Because the blocking dummy 14 can only travel inwardly initially, the trainee learns to reverse the momentum of the opposing player prior to rolling his hips forward to further the lifting action required to control the opposing player. Typically, the player will move the sleeve component 22 inwardly a distance of six inches before he is able to roll his hips and lift. During the lifting motion, the component 22 can, of course, be forced further inwardly or rearwardly. When the pad or dummy 14 is released, spring 35 will return the sleeve component 22 outwardly or forwardly, while the forces of gravity, at the same time, release the arm structure 13 to swing downwardly to the FIG. 3 position. The latch 39, operating under the influence of gravity, automatically hooks under the pin 40 to lock the arm structure against vertical movement in the manner indicated in FIG. 3.

It is considered important that the arm structure be free to pivot freely, once latch 39 is released, so that players of varied height and size can lift along an individual arc which corresponds to their particular physiques and achieve full arm extension. Coaches with training sleds of the present invention are better able to observe a players' lifting motion than they are with training devices which follow trucks and automatically move upwardly when the player may be only pushing the blocking pad inwardly.

It is to be understood that the embodiments described are exemplary of various forms of the invention only and that the invention is defined in the appended claims which contemplate various modifications within the spirit and scope of the invention.

I claim:

1. In a practice sled for use in training football players to perfect their blocking and block evading techniques:

a) a frame;

b) a forwardly extending arm structure mounted on said frame c) a blocking pad assembly having a rearwardly extending component telescopically mounted on said arm structure for rearward movement in a movement path relative thereto under the impetus of a player forcing the blocking pad assembly rearwardly;

d) a yieldable force resisting device connected to resist rearward movement of said blocking pad assembly;

e) a mount connecting said arm structure to said frame for movement relative thereto to permit said blocking pad assembly to raise and lower with movement of said arm structure relative to said frame; and f) restraining mechanism operable when said blocking pad assembly is in forward position to prevent the player from moving said arm structure to raise said blocking pad assembly until said blocking pad assembly has moved a predetermined distance rearwardly on said arm structure.

2. The practice sled of claim 1 wherein said mount comprises a pivot and said restraining mechanism includes a releasable latch having a path of movement from a first locking position in which said arm structure is fixed to said frame to a second unlatched position in which said latch has released said arm structure from the frame for upward pivotal movement thereon.

3. The practice sled of claim 2 wherein said latch is pivotally mounted on said arm structure, said frame having a part engaged by said latch from below to prevent upward pivotal movement of said arm structure relative to said frame, and a latch trip is provided in the path of movement of said blocking pad component which automatically releases said latch after a predetermined rearward movement of said blocking pad assembly.

4. The practice sled of claim 3 wherein said frame part is a pin connected to said arm structure to extend crosswisely relative to the movement path of said blocking pad assembly, and said latch is a hook pivotally mounted on said arm structure above said pin to swing vertically under the influence of gravity to engage under said pin when the blocking pad assembly is restored forwardly.

5. The practice sled of claim 2 wherein said force resisting device is a compressed coil spring carried by said arm structure in position to be further compressed by said blocking pad assembly.

6. The practice sled of claim 5 wherein said blocking pad component comprises an operating sleeve and said arm structure has a sleeve with internal slide bearings, in which said operating sleeve is telescopically received, said operating sleeve having a co-extending spring rod on which said coil spring is retained, said operating sleeve having a crosswisely extending member in alignment with said spring for compressing said spring during rearward movement of said operating sleeve.

7. The practice sled of claim 2 wherein stop surfaces on said arm structure and frame limit the raising movement of said arm structure.

8. A method of constructing a practice sled for use in training football players to perfect their blocking and block evading techniques, the sled having; a frame; a forwardly extending arm structure, having a front end carrying a blocking pad assembly, mounted on the frame for movement relative thereto to raise and lower said blocking pad assembly; said blocking pad assembly being telescopically mounted by the arm structure for rearward movement relative thereto under the impetus of a player forcing the blocking pad assembly rearwardly; and a yieldable force resisting element connected to resist rearward movement of the blocking pad assembly; the steps of:

a) mounting an automatically releasable restraint, operable when the blocking pad assembly is in forward position to prevent the player from raising the blocking pad assembly until the blocking pad assembly has moved a predetermined distance rearwardly on the arm structure, between the frame and arm structure.

9. A method of operating a football training sled; having a frame; a forwardly extending arm structure having a front end mounting a blocking pad assembly, mounted on the frame for movement relative thereto to raise and lower said blocking pad assembly; said blocking pad assembly being mounted by the arm structure for rearward movement relative thereto under the impetus of a player forcing the blocking pad assembly rearwardly; a yieldable force resister connected to resist rearward movement of the blocking pad assembly, and a releasable latching mechanism operable when the blocking pad assembly is in forward position to prevent the player from moving the arm structure to raise the blocking pad assembly until the blocking pad assembly has moved a predetermined distance rearwardly on the arm structure; the steps of:

a) forcing the blocking pad assembly rearwardly against the yieldable force resister while the latching mechanism restrains movement of the arm structure on the frame to raise the blocking pad assembly; and b) only after the blocking pad assembly has moved a predetermined distance rearwardly, automatically unlatching the latching mechanism to permit the player to freely move the mounting arm structure to raise the blocking pad assembly while continuing to move the blocking pad assembly rearwardly.

10. The method of claim 9 comprising the additional step of allowing the blocking pad to move to forward position under a return force exerted by the force resister and permitting gravity forces to relatch said latching mechanism during said movement to forward position.

11. In a practice sled for use in training football players to perfect their blocking and block evading techniques:

a) a frame;

b) a forwardly extending arm structure, having front and rear ends, pivotally mounted on said frame for raising and lowering swinging travel of its front end relative thereto;

c) a blocking pad assembly having a rearwardly extending component telescopically mounted on said front end of the arm structure for rearward movement in a movement path relative thereto under the impetus of a player forcing the blocking pad rearwardly;

d) a yieldable force resisting device connected to resist said rearward movement of said blocking pad; and e) a releasable restraining latch connected between said frame and arm structure to be operable when said blocking pad is in forward position to prevent the player from raising said arm structure until said blocking pad has moved a predetermined distance rearwardly on said arm structure.

* * * * *